US009324511B2

(12) United States Patent
Chang

(10) Patent No.: US 9,324,511 B2
(45) Date of Patent: Apr. 26, 2016

(54) SWITCH MECHANISM AND RELATED ELECTRONIC DEVICE

(71) Applicant: Wistron Corporation, New Taipei (TW)

(72) Inventor: Sung-Ling Chang, New Taipei (TW)

(73) Assignee: Wistron Corporation, Hsichih, New Taipei (TW)

( * ) Notice: Subject to any disclaimer, the term of this patent is extended or adjusted under 35 U.S.C. 154(b) by 207 days.

(21) Appl. No.: 14/174,819

(22) Filed: Feb. 6, 2014

(65) Prior Publication Data

US 2015/0096871 A1 Apr. 9, 2015

(30) Foreign Application Priority Data

Oct. 8, 2013 (TW) ..... 102136369 A

(51) Int. Cl.

| | |
|---|---|
| ***H01H 9/22*** | (2006.01) |
| ***H01H 3/16*** | (2006.01) |
| ***H01H 13/18*** | (2006.01) |
| *H01H 9/04* | (2006.01) |
| *H01H 1/36* | (2006.01) |

(52) U.S. Cl.

CPC ..... *H01H 9/22* (2013.01); *H01H 3/161* (2013.01); *H01H 13/183* (2013.01); *H01H 1/365* (2013.01); *H01H 9/04* (2013.01)

(58) Field of Classification Search

CPC ..... H01R 13/701; H01H 2003/167; H01H 3/161; H01H 13/18; H01H 15/14; H01H 1/40; H01H 1/403; H01H 9/22

USPC ..... 200/50.04, 43.02, 61.61, 50.12, 50.1

See application file for complete search history.

(56) References Cited

U.S. PATENT DOCUMENTS

| | | | | | |
|---|---|---|---|---|---|
| 5,193,667 | A * | 3/1993 | Choi | H01H 9/226 | 300/331 |
| 5,268,629 | A * | 12/1993 | Franke | H01R 13/703 | 320/114 |
| 5,612,520 | A * | 3/1997 | Toedtman | H01H 9/226 | 200/16 D |
| 9,230,752 | B2 * | 1/2016 | Lee | H01H 13/16 | 200/331 |

FOREIGN PATENT DOCUMENTS

| | | |
|---|---|---|
| TW | 388555 | 4/2000 |
| TW | M354979 | 4/2009 |

* cited by examiner

*Primary Examiner* — Felix O Figueroa
(74) *Attorney, Agent, or Firm* — Winston Hsu; Scott Margo

(57) ABSTRACT

A switch mechanism capable of preventing a battery from short is disclosed in the present invention. The switch mechanism includes a base, a circuit board, a connector and a cover. The base has an accommodating space for accommodating the battery with a first terminal. The circuit board with a second terminal is disposed on the base. The connector is movably disposed on the base and moves between a first position and a second position. The connector located at the first position does not contact the first terminal or the second terminal. The cover is detachably disposed on the base. The cove includes an actuating portion, which moves the connector from the first position to the second position when the cove is assembled with the base, so that the connector simultaneously contacts the first terminal and the second terminal to electrically connect the battery with the circuit board.

20 Claims, 7 Drawing Sheets

SWITCH MECHANISM AND RELATED ELECTRONIC DEVICE

BACKGROUND OF THE INVENTION

1. Field of the Invention

The present invention relates to an electronic device capable of replacing the battery, and more particularly, to an electronic device utilizing a switch mechanism to increase safety of the battery.

2. Description of the Prior Art

The portable electronic device includes a rechargeable/replaceable battery to increase usage time of the portable electronic device. The battery is detachably disposed inside a casing of the portable electronic device, and a cover is utilized to shelter the battery for preferred aesthetic. Information stored in the portable electronic device may easily lose or damage by accident power failure as assembly of the battery is incorrect. The conventional cover provides basic sheltery function, and is unable to inspect and to remind whether the battery is accurately installed inside the casing. As the battery is electrically connected to a main board of the portable electronic device before the casing is sealed by the cover, the battery is easily short by liquid leakage. Thus, design of a fixing mechanism capable of electrically connecting the battery with the main board under safety mode is an important issued in the related mechanical industry.

SUMMARY OF THE INVENTION

The present invention provides an electronic device utilizing a switch mechanism to increase safety of the battery for solving above drawbacks.

According to the claimed invention, a switch mechanism capable of preventing a battery from short is disclosed. The switch mechanism includes a base, a circuit board, a connector and a cover. The base includes a bottom and a plurality of lateral walls. The plurality of lateral walls surrounds the bottom to form an accommodating space for accommodating the battery. The battery includes a first terminal. The circuit board is disposed on the base. The circuit board includes a second terminal. The connector is movably disposed on the base and adapted to switch between a first position and a second position. The connector does not contact the first terminal or the second terminal when locating at the first position. The cover is detachably disposed on the base. The base includes an actuating portion. The actuating portion moves the connector from the first position to the second position when the cove is assembled with the base, so as to drive the connector to simultaneously contact the first terminal and the second terminal to electrically connect the battery with the circuit board.

According to the claimed invention, an opening is formed on one of the plurality of the lateral walls. The first terminal aligns with the opening when the battery is accommodated inside the accommodating space. The second terminal is disposed on a position of the circuit board adjacent to the opening.

According to the claimed invention, the connector is slidably disposed on the base. The connector located at the first position is outside the lateral wall opposite to the accommodating space, and the connector located at the second position partly passes through the opening on the lateral wall to insert into the accommodating space.

According to the claimed invention, the connector includes two conductive ends to electrically connect the first terminal and the second terminal. The conductive end is an elastic piece or a plug.

According to the claimed invention, the actuating portion is an inclined structure, and the inclined structure presses the connector to move the connector relative to the base.

According to the claimed invention, the connector is slidably disposed on one of the plurality of lateral walls and is disposed on an inner side of the lateral wall facing the accommodating space.

According to the claimed invention, the connector is spaced from the second terminal when locating at the first position. The connector contacts against the second terminal and is located between the lateral wall and the battery when locating at the second position.

According to the claimed invention, the switch mechanism further includes a resilient component. Two ends of the resilient component are respectively connected to the base and the connector to move the connector from the second position to the first position.

According to the claimed invention, the switch mechanism further includes a waterproof component disposed around the cover in a compressible deformable manner.

According to the claimed invention, the cover shelters the accommodating space to move the connector to the second position by the actuating portion, and the waterproof component is disposed inside a gap between the cover and the accommodating space.

According to the claimed invention, an electronic device includes a battery, a casing and a switch mechanism. The battery includes a first terminal. The switch mechanism is disposed on the casing. The switch mechanism includes a base, a circuit board, a connector and a cover. The base includes a bottom and a plurality of lateral walls. The plurality of lateral walls surrounds the bottom to form an accommodating space for accommodating the battery. The circuit board is disposed on the base. The circuit board includes a second terminal. The connector is movably disposed on the base and adapted to switch between a first position and a second position. The connector does not contact the first terminal or the second terminal when locating at the first position. The cover is detachably disposed on the base. The base includes an actuating portion. The actuating portion moves the connector from the first position to the second position when the cove is assembled with the base, so as to drive the connector to simultaneously contact the first terminal and the second terminal to electrically connect the battery with the circuit board.

The switch mechanism of the present invention can switch modes of the electrical connection between the battery and the circuit board according to assembly/disassembly of the cover and the base. The battery does not provide the energy to the electronic components of the electronic device when the battery is installed inside the accommodating space of the base without the cover. The electronic device receives the energy from the battery when the battery and the cover are both accurately assembled. The present invention reminds the user of battery disassembly and cover disassembly by energy loss, so the electronic device is adapted to operate in specific mode (such as the waterproof mode) to enhance product safety.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
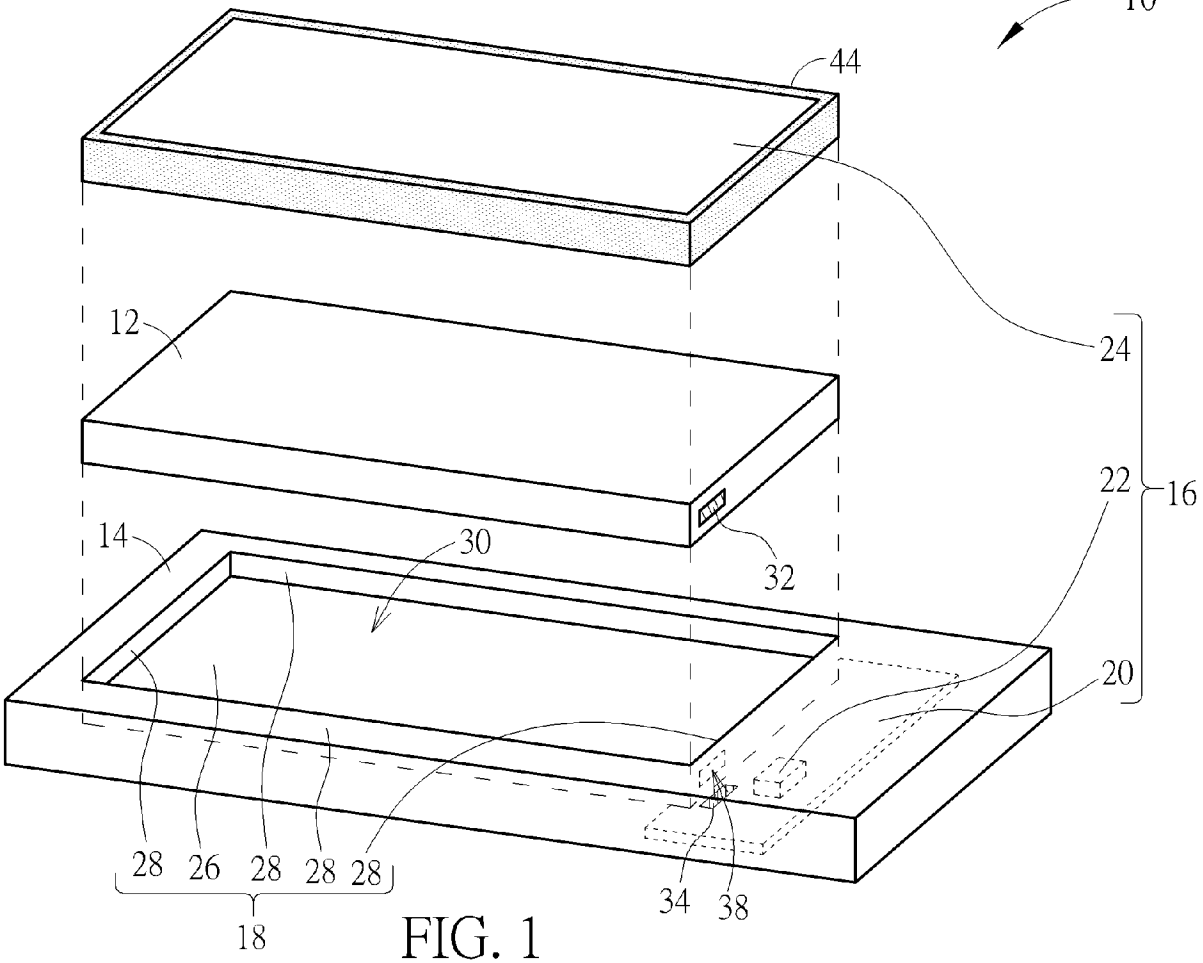
FIG. 1 is a diagram of an electronic device according to an embodiment of the present invention.

Please refer to FIG. 1. FIG. 1 is a diagram of an electronic device 10 according to an embodiment of the present invention. The electronic device 10 includes a battery 12. a casing 14 and a switch mechanism 16. The battery 12 can be a rechargeable battery. A plurality of electronic components of the electronic device 10, such as the main board, the memory, the processor and so on, is disposed inside the casing 14. The switch mechanism 16 is disposed on the casing 14, and can be adapted to switch electrical connection of the battery 12 according to sheltery protection of the battery 12. The switch mechanism 16 controls the battery 12 to provide energy to the electronic device 10 when the battery 12 is accurately installed inside the casing 14 and the sheltery protection is actuated, so as to prevent information of the electronic device 10 from loss due to incorrect assembly of the battery 12, and to prevent the battery 12 from short due to the closed sheltery protection.

Figure 2:
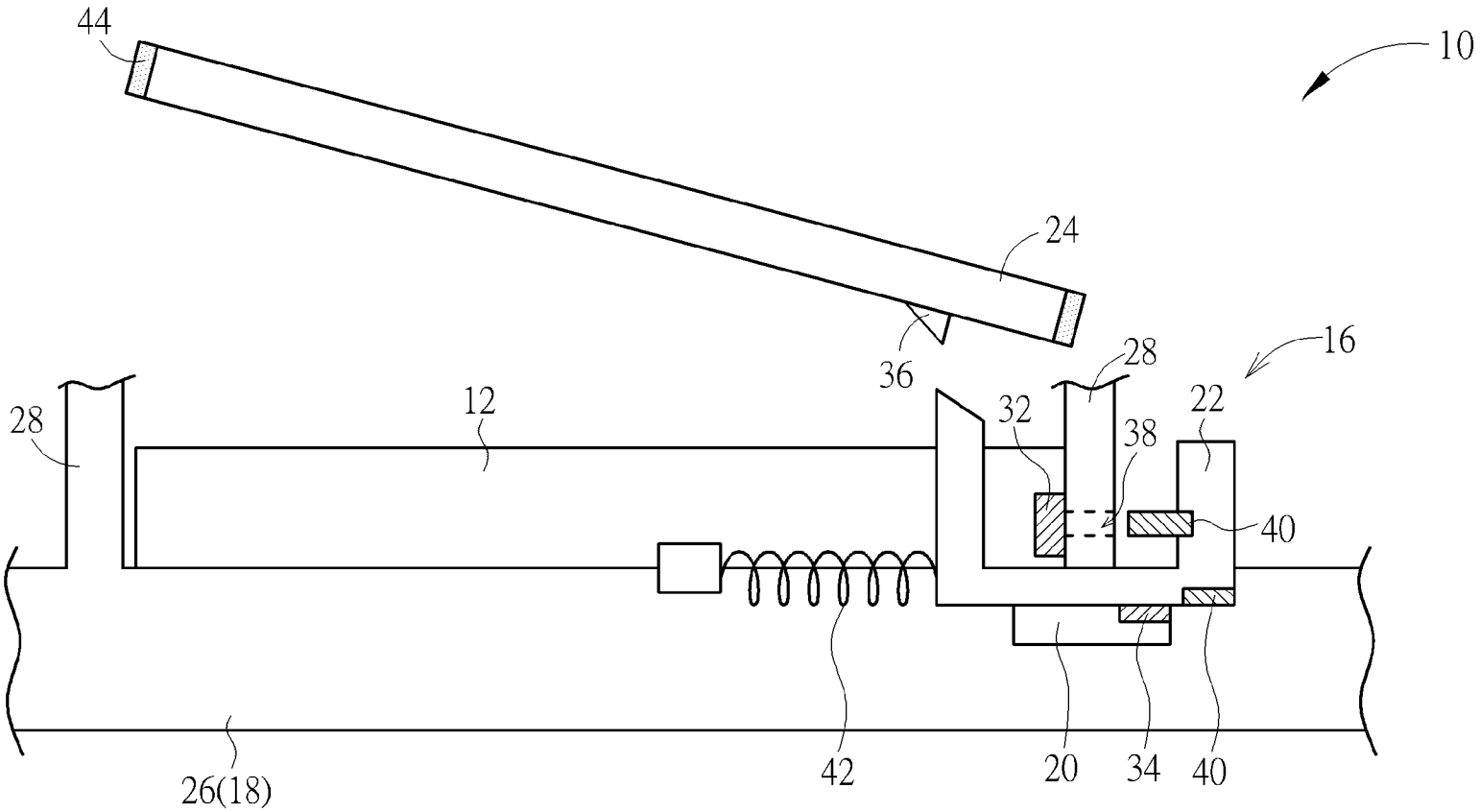
FIG. 2 and FIG. 3 respectively are sectional views of the electronic device in different operation modes according to the first embodiment of the present invention.
Figure 3:
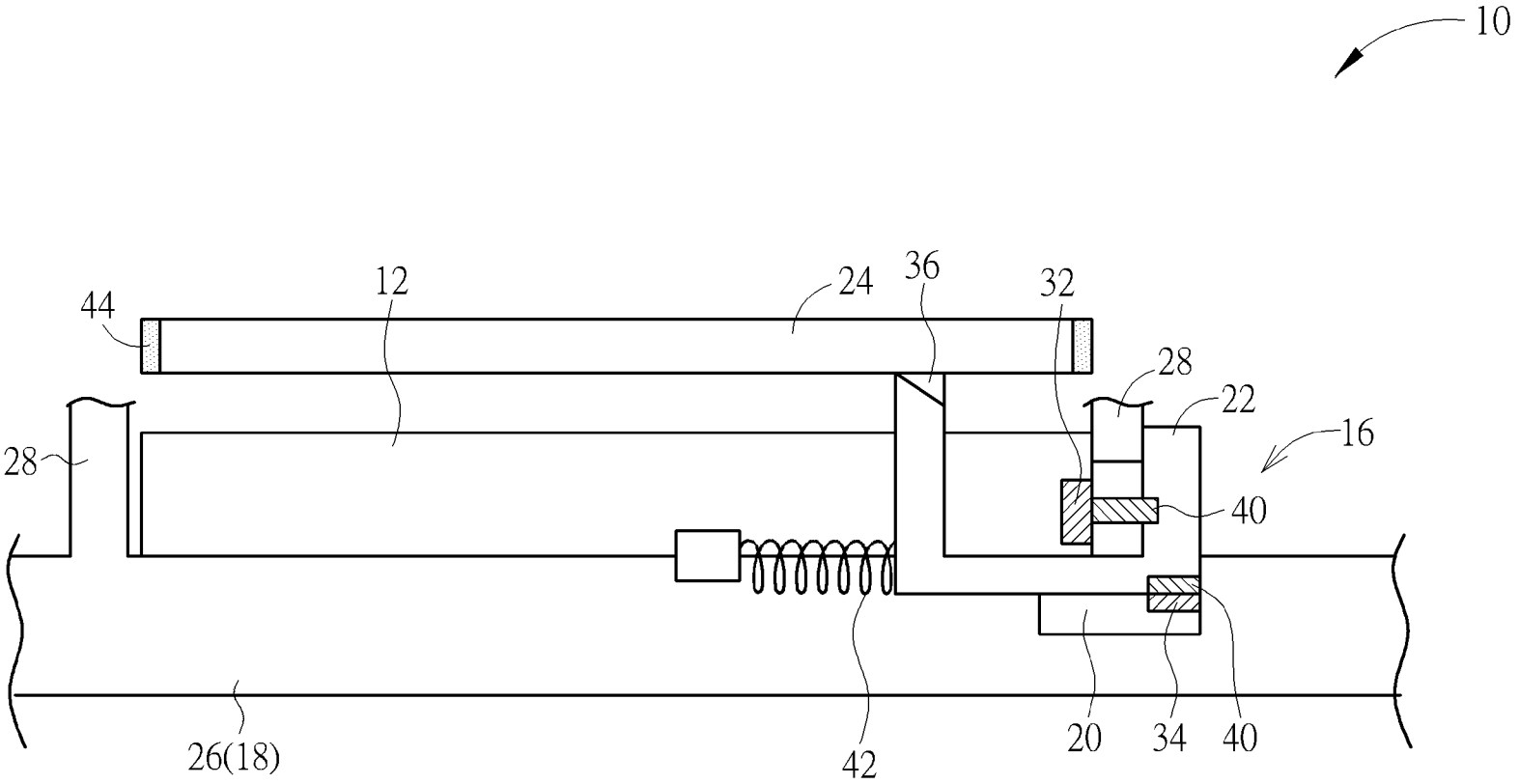

Please refer to FIG. 1 to FIG. 3. FIG. 2 and FIG. 3 respectively are sectional views of the electronic device 10 indifferent operation modes according to the first embodiment of the present invention. The switch mechanism 16 includes a base 18, a circuit board 20, a connector 22 and a cover 24. The base 18 includes a bottom 26 and a plurality of lateral walls 28. The plurality of lateral walls 28 surrounds the bottom 26 to form an accommodating space 30. The battery 12 is installed inside the accommodating space 30 of the casing 14. The circuit board 20 is disposed on the base 18. The battery 12 and the circuit 20 respectively include a first terminal 32 and a second terminal 34. The connector 22 is movably disposed on the base 18. The cover 24 is detachably disposed on the base 18. The switch mechanism 16 switches the electrical connection between the battery 12 and the circuit board 20 according to position of the cover 24. For example, the connector 22 does not connect the battery 12 with the circuit board 20 when the cover 24 is disassembled from the base 18, and an actuating portion 36 of the cover 24 drives the connector 22 to connect the battery 12 with the circuit board 20 when the cover 24 is assembled with the base 18 to shelter the accommodating space 30.

An opening 38 can be formed on one of the plurality of lateral walls 28. The second terminal 34 is disposed on a position of the circuit board 20 adjacent to the opening 38, or the circuit board 20 is disposed on the base 18 to make the second terminal 34 close to the opening 38. The first terminal 32 aligns with the opening 38 when the battery 12 is accommodated inside the accommodating space 30. In addition, the connector 22 can include two conductive ends 40 made of conductive material, and the conductive end 40 can be an elastic piece or a plug. When the cover 24 is assembled with the base 18, the actuating portion 36 moves the connector 22 relative to the base 18, the conductive ends 40 of the connector 22 simultaneously contact the first terminal 32 of the battery 12 and the second terminal 34 of the circuit board 20, respectively.

The switch mechanism 16 further can include a resilient component 42 and a waterproof component 44. Two ends of the resilient component 42 are respectively connected to the base 18 and the connector 22. Resilient recovering force of the resilient component 42 is utilized to move the connector 22 relative to the base 18. The resilient component can be omitted selectively, and the connector 22 is manually moved from the second position to the first position. The waterproof component 44 can be made of rubber material. A shape of the waterproof 44 corresponds to structure of the cover 24. The waterproof 44 is disposed around the cover 24 in a compressible deformable manner. When the cover 24 shelters the accommodating space 30, the waterproof 44 is deformed to tightly block inside a gap between the cover 24 and the accommodating space 30 (or the lateral wall 28 of the base 18), to prevent the electronic component inside the casing 14 from damage by liquid leakage.

As shown in FIG. 2, the connector 22 is located at the first position. The conductive end 40 of the connector 22 does not contact the first terminal 32 or the second terminal 34, the resilient component 42 without external force is not resiliently deformed, and the battery 12 is not electrically connected to the circuit board 20. As shown in FIG. 3, the actuating portion 36 of the cover 24 moves the connector 22 to the second position when the cover 24 shelters the accommodating space 30, and the resilient component 42 is resiliently deformed to store the resilient recovering force. One of the conductive ends 40 (such as the plug) of the connector 22 passes through the opening 38 on the lateral wall 28 to contact the first terminal 32 of the battery 12, the other conductive end 40 (such as the elastic piece) of the connector 22 contacts the second terminal 34 of the circuit board 20, so as to electrically connect the battery 12 with the circuit board 20. The actuating portion 36 can be an inclined structure. The actuating portion 36 utilizes component force to move the connector 22 relative to the base 18 when the cover 24 is pressed, and the connector 22 moves from the first position shown in FIG. 2 to the second position shown in FIG. 3. When the cover 24 is removed, the resilient recovering force of the resilient component 42 is released to move the connector 22 from the second position to the first position.

In the first embodiment of the present invention, the connector 22 is slidably disposed on the bottom 26 of the base 18, and located outside the lateral wall 28 opposite to the accommodating space 30. It is to say, the connector 22 located at the first position is out of the accommodating space 30, as shown in FIG. 2. Part of the connector 22 (one of the conductive ends 40) inserts into the opening 38 when the connector 22 is located at the second position, as shown in FIG. 3; meanwhile, a main body of the connector 22 is outside the accommodating space 30. The two conductive ends 40 can respectively contact the first terminal 32 and the second terminal 34 to establish the electrical connection between the battery 12 and the circuit board 20.

Figure 4:
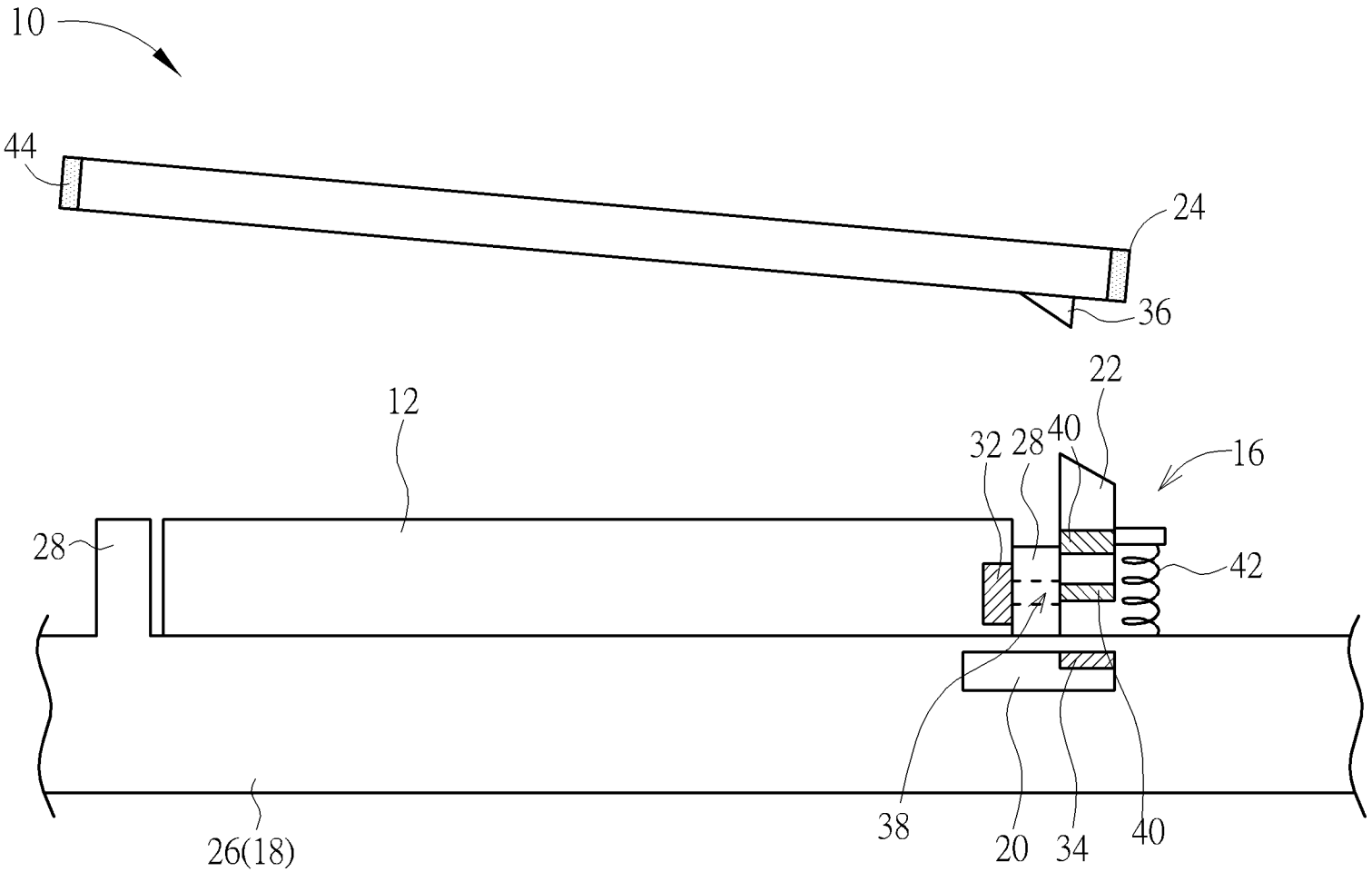
FIG. 4 and FIG. 5 respectively are sectional views of the electronic device according to the second embodiment of the present invention.
Figure 5:
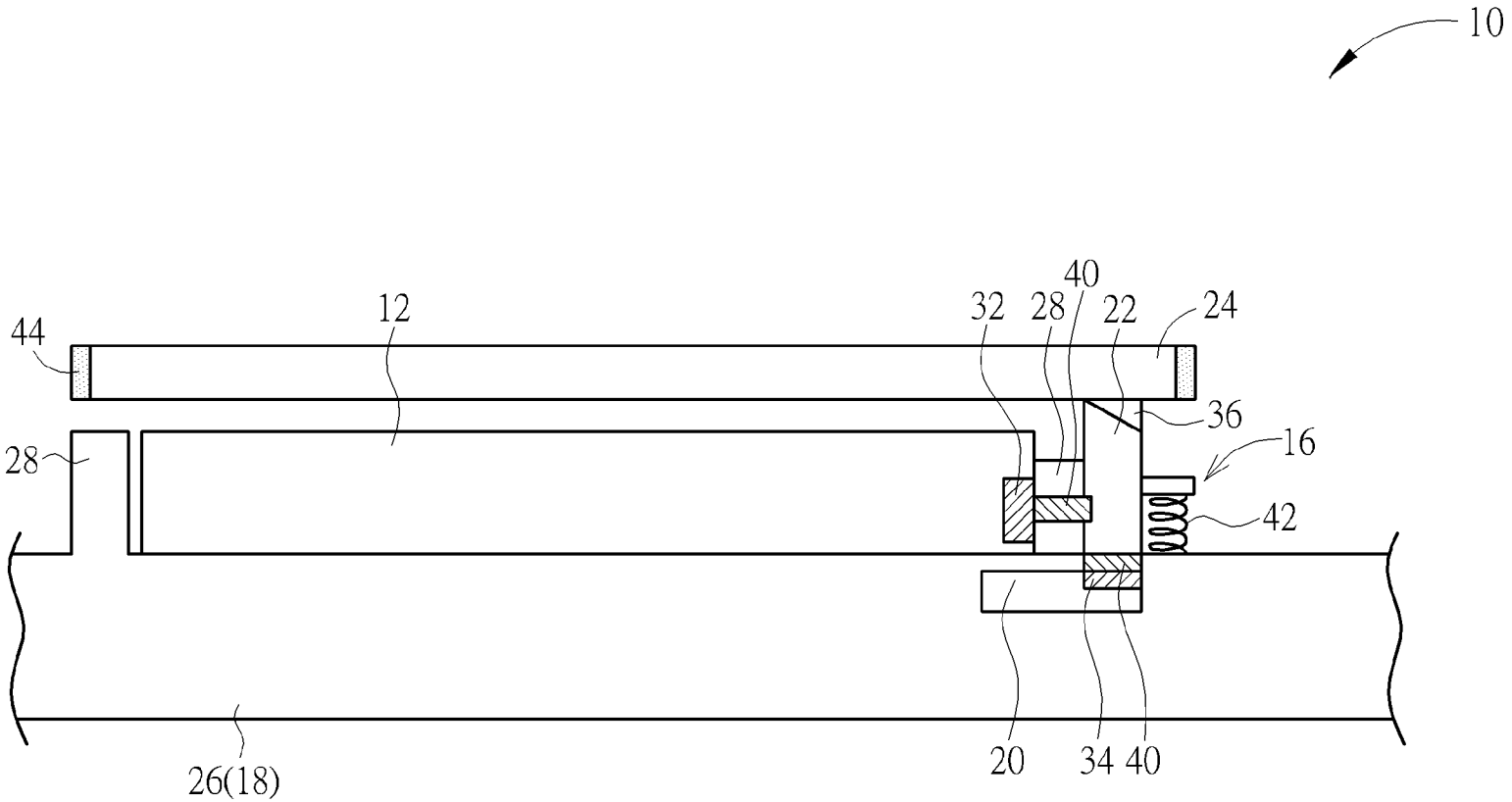

Please refer to FIG. 4 and FIG. 5. FIG. 4 and FIG. 5 respectively are sectional views of the electronic device 10' according to the second embodiment of the present invention. In the second embodiment, elements having the same numeral as ones of the first embodiment have the same structures and functions, and a detailed description is omitted herein for simplicity. As shown in FIG. 4, the resilient component 42 can hold the connector 22, and the connector 22 is suspended over the base 18. Further, the connector 22 can be suspended at the first position by the resilient component 42.

The conductive ends 40 of the connector 22 shown in FIG. 4 do not contact the first terminal 32 of the battery 12 and the second terminal 34 of the circuit board 20. As shown in FIG. 5, the cover 24 is assembled with the base 18, the actuating portion 36 of the cover 24 presses the connector 22, the connector 22 moves relative to the base 18 downwardly (and further slip in parallel) and is located at the second position.

The upper conductive end 40 can be the elastic piece. The upper conductive end 40 contacts against the lateral wall 28 to store resilient recovering force when the connector 22 is located at the first position. The upper conductive end 40 aligns with the opening 38 when the connector 22 moves to the second position, and the resilient recovering force drives the upper conductive end 40 to pass through the opening 38 to contact the first terminal 32. The lower conductive end 40 can be the plug. The lower conductive end 40 inserts into the second terminal 34 when the connector 22 moves to the second position, so as to electrically connect the battery 12 with the circuit board 20. In the second embodiment, forms of the conductive end 40 are not limited to the elastic piece and the plug as mentioned above, which depend on design demand.

Figure 6:
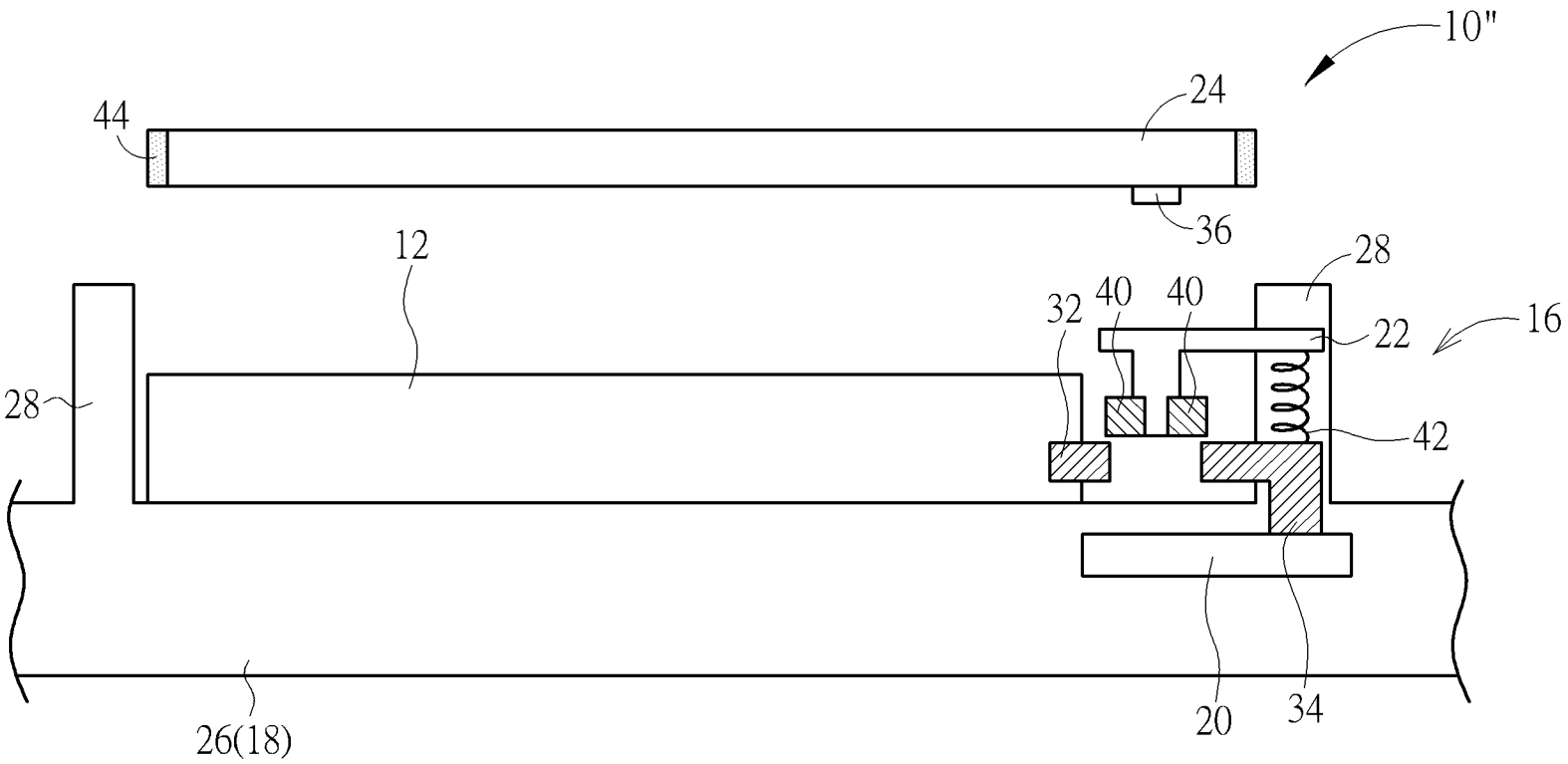
FIG. 6 and FIG. 7 respectively are sectional views of the electronic device in different operation modes according to the third embodiment of the present invention.
Figure 7:
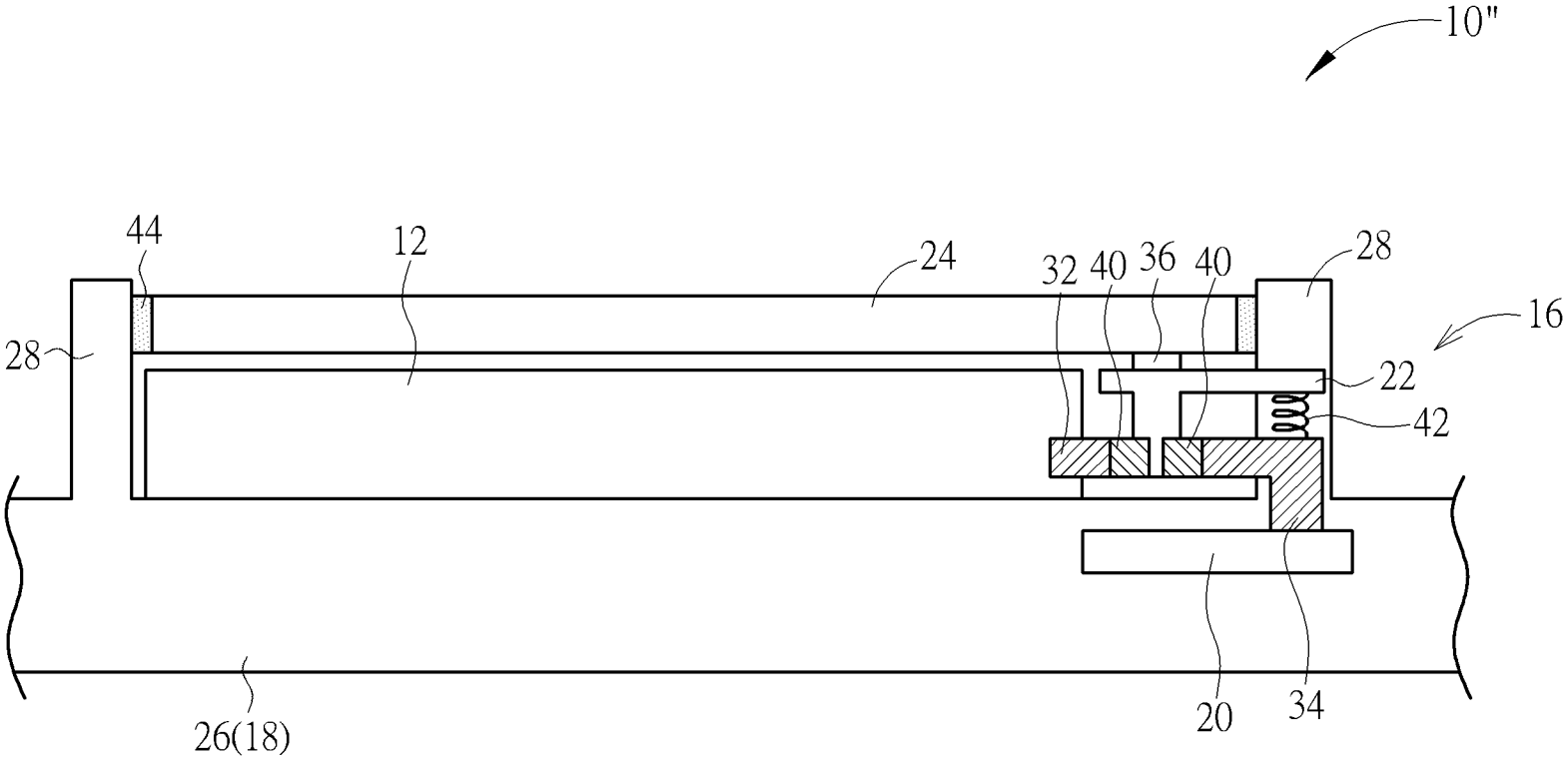

Please refer to FIG. 6 and FIG. 7. FIG. 6 and FIG. 7 respectively are sectional views of the electronic device 10" in different operation modes according to the third embodiment of the present invention. In the third embodiment, elements having the same numeral as ones of the above-mentioned embodiments have the same structures and functions, and a detailed description is omitted herein for simplicity. As shown in FIG. 6, the connector 22 is slidably disposed on the lateral wall 28, and preferably on an inner side of the lateral wall 28 facing the accommodating space 30. As the connector 22 is located at the first position shown in FIG. 6, the conductive ends 40 are respectively spaced from the first terminal 32 and the second terminal 34. As the cover 24 is assembled with the base 18 shown in FIG. 7, the actuating portion 36 pushes the connector 22 relative to the lateral wall 28 downwardly to be located at the second position. The conductive ends 40 can simultaneously contact the first terminal 32 and the second terminal 34 to establish the electrical connection between the battery 12 and the circuit board 20.

Difference between the third embodiment and the above-mentioned embodiments is that the connector 22 of the third embodiment is located between the lateral 28 and the battery 12. The conductive end 40 of the connector 22 is preferably designed as the elastic piece. When the connector 22 moves to the second position, the conductive ends 40 disposed on opposite surfaces of the connector 22 can respectively contact against the first terminal 32 and the second terminal 34 tightly to establish the electrical connection. Further, the resilient recovering force generated by the conductive ends 40, which are designed as the elastic piece, can be utilized to fix the battery 12 inside the base 18, to effectively increase assembly strength of the battery 12, the cover 24 and the base 18.

The present invention provides the switch mechanism and the related electronic device capable of switching the electrical connection between the battery and the circuit board according to assembly/disassembly of the cover. As the cover is disassembled from the base, the connector of the switch mechanism can stay at the first position by manual drive or the resilient component. The connector located at the first position does not contact the first terminal and the second terminal, or does not contact one of the first terminal and the second terminal merely, so as to isolate the electrical connection between the battery and the circuit board. As the cover is assembled with the base, the actuating portion moves the connector to the second position with movement of the cover. The conductive ends of the connector located at the second position can simultaneously contact the first terminal and the second terminal to electrically connect the battery with the circuit board, and the electronic device is able to be started.

It should be mentioned that the electronic device disposes the waterproof component between the base and the cover to avoid the liquid leakage, and the battery is electrically connected to the circuit board by the switch mechanism when the cover has been assembled with the base. Therefore, the electronic device receives the energy of the battery after the cover is assembled, to ensure that the electronic device can be turned on by accurate assembly of the battery and the cover. The conductive ends of the connector are spaced from the first terminal and the second terminal by the switch mechanism when the cover is not accurately assembled with the base, and the electrical connection between the battery and the circuit board is broken. The electronic device cannot be turned on to prevent the inner electronic components from short due to the liquid leakage.

Comparing to the prior art, the switch mechanism of the present invention can switch modes of the electrical connection between the battery and the circuit board according to assembly/disassembly of the cover and the base. The battery does not provide the energy to the electronic components of the electronic device when the battery is installed inside the accommodating space of the base without the cover. The electronic device receives the energy from the battery when the battery and the cover are both accurately assembled. The present invention reminds the user of battery disassembly and cover disassembly by energy loss, so the electronic device is adapted to operate in specific mode (such as the waterproof mode) to enhance product safety.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A switch mechanism capable of preventing a battery from short, the switch mechanism comprising:

a base, the base comprising a bottom and a plurality of lateral walls, the plurality of lateral walls surrounding the bottom to form an accommodating space for accommodating the battery, the battery comprising a first terminal;

a circuit board disposed on the base, the circuit board comprising a second terminal;

a connector movably disposed on the base and adapted to switch between a first position and a second position, the connector not contacting the first terminal or the second terminal when locating at the first position; and a cover detachably disposed on the base, the base comprising an actuating portion, the actuating portion moving the connector from the first position to the second position when the cove is assembled with the base, so as to drive the connector to simultaneously contact the first terminal and the second terminal to electrically connect the battery with the circuit board.

2. The switch mechanism of claim 1, wherein an opening is formed on one of the plurality of the lateral walls, the first terminal aligns with the opening when the battery is accommodated inside the accommodating space, the second terminal is disposed on a position of the circuit board adjacent to the opening.

3. The switch mechanism of claim 2, wherein the connector is slidably disposed on the base, the connector located at the first position is outside the lateral wall opposite to the accommodating space, and the connector located at the second position partly passes through the opening on the lateral wall to insert into the accommodating space.

4. The switch mechanism of claim 1, wherein the connector comprises two conductive ends to electrically connect the first terminal and the second terminal, the conductive end is an elastic piece or a plug.

5. The switch mechanism of claim 1, wherein the actuating portion is an inclined structure, the inclined structure presses the connector to move the connector relative to the base.

6. The switch mechanism of claim 1, wherein the connector is slidably disposed on one of the plurality of lateral walls and is disposed on an inner side of the lateral wall facing the accommodating space.

7. The switch mechanism of claim 6, wherein the connector is spaced from the second terminal when locating at the first position, the connector contacts against the second terminal and is located between the lateral wall and the battery when locating at the second position.

8. The switch mechanism of claim 1, further comprising:

a resilient component, two ends of the resilient component being respectively connected to the base and the connector to move the connector from the second position to the first position.

9. The switch mechanism of claim 1, further comprising:

a waterproof component disposed around the cover in a compressible deformable manner.

10. The switch mechanism of claim 9, wherein the cover shelters the accommodating space to move the connector to the second position by the actuating portion, and the waterproof component is disposed inside a gap between the cover and the accommodating space.

11. An electronic device comprising:

a battery, the battery comprising a first terminal;

a casing; and a switch mechanism disposed on the casing, the switch mechanism comprising:

a base, the base comprising a bottom and a plurality of lateral walls, the plurality of lateral walls surrounding the bottom to form an accommodating space for accommodating the battery;

a circuit board disposed on the base, the circuit board comprising a second terminal;

a connector movably disposed on the base and adapted to switch between a first position and a second position, the connector not contacting the first terminal or the second terminal when locating at the first position; and a cover detachably disposed on the base, the base comprising an actuating portion, the actuating portion moving the connector from the first position to the second position when the cove is assembled with the base, so as to drive the connector to simultaneously contact the first terminal and the second terminal to electrically connect the battery with the circuit board.

12. The electronic device of claim 11, wherein an opening is formed on one of the plurality of the lateral walls, the first terminal aligns with the opening when the battery is accommodated inside the accommodating space, the second terminal is disposed on a position of the circuit board adjacent to the opening.

13. The electronic device of claim 12, wherein the connector is slidably disposed on the base, the connector located at the first position is outside the lateral wall opposite to the accommodating space, and the connector located at the second position partly passes through the opening on the lateral wall to insert into the accommodating space.

14. The electronic device of claim 11, wherein the connector comprises two conductive ends to electrically connect the first terminal and the second terminal, the conductive end is an elastic piece or a plug.

15. The electronic device of claim 11, wherein the actuating portion is an inclined structure, the inclined structure presses the connector to move the connector relative to the base.

16. The electronic device of claim 11, wherein the connector is slidably disposed on one of the plurality of lateral walls and is disposed on an inner side of the lateral wall facing the accommodating space.

17. The electronic device of claim 16, wherein the connector is spaced from the second terminal when locating at the first position, the connector contacts against the second terminal and is located between the lateral wall and the battery when locating at the second position.

18. The electronic device of claim 11, wherein the switch mechanism further comprises:

a resilient component, two ends of the resilient component being respectively connected to the base and the connector to move the connector from the second position to the first position.

19. The electronic device of claim 11, wherein the switch mechanism further comprises:

a waterproof component disposed around the cover in a compressible deformable manner.

20. The electronic device of claim 19, wherein the cover shelters the accommodating space to move the connector to the second position by the actuating portion, and the waterproof component is disposed inside a gap between the cover and the accommodating space.

* * * * *